US011311759B2

(12) United States Patent
Kikuchi et al.

(10) Patent No.: US 11,311,759 B2
(45) Date of Patent: Apr. 26, 2022

(54) SPRINKLER HEAD

(71) Applicant: SENJU SPRINKLER CO., LTD., Tokyo (JP)

(72) Inventors: Masakatsu Kikuchi, Tokyo (JP); Yutaka Tateishi, Tokyo (JP); Yuki Iizawa, Tokyo (JP); Masashi Murakami, Tokyo (JP)

(73) Assignee: SENJU SPRINKLER CO., LTD., Tokyo (JP)

( * ) Notice: Subject to any disclaimer, the term of this patent is extended or adjusted under 35 U.S.C. 154(b) by 0 days.

(21) Appl. No.: 16/923,728

(22) Filed: Jul. 8, 2020

(65) Prior Publication Data

US 2021/0197002 A1 Jul. 1, 2021

(30) Foreign Application Priority Data

Jul. 16, 2019 (JP) ..... JP2019-131189

(51) Int. Cl.
*A62C 37/12* (2006.01)

(52) U.S. Cl.
CPC ..... *A62C 37/12* (2013.01)

(58) Field of Classification Search
CPC ..... A62C 37/11; A62C 37/12; A62C 37/09
See application file for complete search history.

(56) References Cited

U.S. PATENT DOCUMENTS 4,015,665 A * 4/1977 Simons ..... A62C 37/09 169/40
4,214,631 A * 7/1980 Hattori ..... A62C 37/12 169/40
4,228,859 A * 10/1980 Hattori ..... A62C 37/12 169/40
4,596,289 A * 6/1986 Johnson ..... A62C 37/09 169/37
4,651,832 A * 3/1987 Kubo ..... A62C 37/10 169/39

(Continued)

FOREIGN PATENT DOCUMENTS

JP 2-109661 U 9/1990
JP 10-179789 A 7/1998

(Continued)

*Primary Examiner* — Joseph A Greenlund
(74) *Attorney, Agent, or Firm* — Cermak Nakajima & McGowan LLP; Tomoko Nakajima

(57) ABSTRACT

A sprinkler head includes a main body, a valve element, a heat-sensitive disassembling unit, a cylindrical frame, a set pin between the valve element and the disassembling unit, and a spring member engaged with the pin. The body includes a nozzle from which fire-extinguishing liquid is discharged. The disassembling unit includes a plunger having an interior circumferential surface. The disassembling unit keeps the nozzle closed with the valve element and opens the nozzle through a breakdown action during activation. The frame includes an upper part connected to the body and a lower part engaged with the disassembling unit. The pin includes a leg inserted in the plunger and including an inclined surface and a straight portion closer to the valve element. The straight portion is in contact with and slidable over the circumferential surface. The breakdown action causes the pin to move, with the inclined surface contacting the circumferential surface.

6 Claims, 8 Drawing Sheets

(56) References Cited

U.S. PATENT DOCUMENTS 4,766,961 A * 8/1988 Macie ..... A62C 37/09 169/37
4,977,963 A * 12/1990 Simons ..... A62C 37/12 169/37
5,094,298 A * 3/1992 Polan ..... A62C 37/09 169/19
5,159,984 A * 11/1992 Hattori ..... A62C 37/14 169/38
5,184,683 A * 2/1993 Takamasa ..... A62C 37/09 169/37
5,373,989 A * 12/1994 Hattori ..... A62C 37/50 239/71
5,924,492 A * 7/1999 Kikuchi ..... A62C 37/12 169/37
8,448,714 B2 * 5/2013 Park ..... A62C 37/12 169/37
9,320,929 B2 * 4/2016 Koiwa ..... A62C 37/08
9,339,675 B2 * 5/2016 Koiwa ..... A62C 37/11
9,463,343 B2 * 10/2016 Koiwa ..... A62C 35/00
2002/0148620 A1 * 10/2002 Polan ..... A62C 37/14 169/38
2006/0037761 A1 * 2/2006 Shim ..... A62C 37/09 169/37
2010/0263883 A1 * 10/2010 Abels ..... A62C 37/12 169/37
2012/0024547 A1 * 2/2012 Orr ..... A62C 37/12 169/37
2012/0261498 A1 * 10/2012 Kameishi ..... A62C 37/12 239/583
2012/0285707 A1 * 11/2012 Kameishi ..... A62C 31/02 169/39
2018/0304111 A1 * 10/2018 Karihara ..... B05B 1/267
2021/0016120 A1 * 1/2021 Kikuchi ..... B05B 3/0486
2021/0197002 A1 * 7/2021 Kikuchi ..... A62C 37/12

FOREIGN PATENT DOCUMENTS

JP 2012-105952 A 6/2012
JP 2014-144153 A 8/2014
JP 2019-055027 A 4/2019

* cited by examiner

SPRINKLER HEAD

BACKGROUND OF THE INVENTION

1. Field of the Invention

The present invention relates to a fire-extinguishing sprinkler head.

2. Description of the Related Art

A sprinkler head sprinkles fire-extinguishing liquid (fire-extinguishing water) when sensing heat of fire. The sprinkler head includes a nozzle and a heat-sensitive disassembling unit. The nozzle is connected to a water-supply pipe. The heat-sensitive disassembling unit goes into action to break down when sensing an outbreak of fire. A valve element and a resilient body such as a coned disc spring are disposed between the nozzle and the heat-sensitive disassembling unit. In ordinary times without an outbreak of fire, the outlet of the nozzle is closed with the valve element (see, for example, Japanese Unexamined Patent Application Publication No. 2012-105952).

A feature of a sprinkler head disclosed in Japanese Unexamined Patent Application Publication No. 2014-144153 is that a set pin is inserted to a coned disc spring. Owing to this structure, the coned disc spring uniformly applies a load to the center of the valve element through the set pin, and the number of constituent components of the sprinkler head disclosed in Japanese Unexamined Patent Application Publication No. 2014-144153 is less than the number of constituent components of the sprinkler head disclosed in Japanese Unexamined Patent Application Publication No. 2012-105952. The sprinkler head disclosed in Japanese Unexamined Patent Application Publication No. 2014-144153 includes one coned disc spring, which applies pressure to press a valve element against a nozzle until the heat-sensitive disassembling unit senses an outbreak of fire and breaks down to fall off from a frame. Reducing the diameter of the coned disc spring in the interest of downsizing the sprinkler head causes a decline in the load applied by the coned disc spring and/or a decline in the flexure of the coned disc spring. This can result in a situation where water leaks from the nozzle before the heat-sensitive disassembling unit breaks down to fall off from the frame. As a result, the heat-sensitive disassembling unit may be cooled by the leakage water, and the activation of the sprinkler head may not be as quick as it should be.

The heat-sensitive disassembling unit of the sprinkler head inclines when being in action. When the heat-sensitive disassembling unit inclines too much, balls and the coned disc spring that are accommodated in the frame can get caught in a step portion of the frame. As a result, the activation of the sprinkler head may not be as smooth as it should be.

SUMMARY OF THE INVENTION

The present invention has been made against a backdrop of the techniques known in the art. The objective of the present invention is to provide a sprinkler head that ensures activation reliability with greater stability.

To attain the objective, the present invention has the following features.

A sprinkler head according to an aspect of the present invention includes a main body, a valve element, a heat-sensitive disassembling unit, a frame, a set pin, and a resilient body. The main body includes a nozzle from which fire-extinguishing water is discharged. The nozzle is closed with the valve element. The heat-sensitive disassembling unit includes a plunger having an interior circumferential surface. The heat-sensitive disassembling unit keeps the nozzle closed with the valve element and opens the nozzle through a breakdown action during activation of the sprinkler head. The frame has a cylindrical shape and includes an upper part connected to the main body and a lower part engaged with the heat-sensitive disassembling unit. The set pin is disposed between the valve element and the heat-sensitive disassembling unit. The set pin includes a leg inserted in the plunger. The leg includes an inclined surface and a straight portion closer than the inclined surface to the valve element. The straight portion is in contact with and slidable over an interior circumferential surface of the plunger. The resilient body is engaged with the set pin. The breakdown action causes the set pin to move, with the inclined surface contacting the interior circumferential surface of the plunger and with inclination of the heat-sensitive disassembling unit from the set pin being rendered possible.

In the initial working stage of the sprinkler head, the straight portion of the set pin is in contact with the interior circumferential surface of the plunger of the heat-sensitive disassembling unit. Owing to this feature, the heat-sensitive disassembling unit caught on the frame moves in line with the straight portion inserted in the plunger when going into action to break down and to fall off from the frame. In this way, the sprinkler head restricts inclination of the heat-sensitive disassembling unit in the initial stage of the breakdown action of the heat-sensitive disassembling unit. The breakdown action of the heat-sensitive disassembling unit causes the set pin to move, with the inclined surface contacting the interior circumferential surface of the plunger. The inclination of the heat-sensitive disassembling unit from the interior circumferential surface of the plunger may be tolerated to a certain extent owing to the inclined surface of the set pin. Once the inclination restriction imposed by the straight portion is removed, the sprinkler head tolerates slight to moderate inclination of the heat-sensitive disassembling unit and prevents excessive inclination of the heat-sensitive disassembling unit.

Another feature of the present invention may be that the heat-sensitive disassembling unit includes a guide-receiving portion that is slidable over a lower-part interior circumferential surface of the frame.

The guide-receiving portion of the heat-sensitive disassembling unit and the lower-part interior circumferential surface of the frame slide over each other. This may restrict the inclination of the heat-sensitive disassembling unit. Furthermore, the straight portion of the set pin and the interior circumferential surface of the plunger slide over each other until the guide-receiving portion gets out of the lower-part interior circumferential surface. Consequently, not only the heat-sensitive disassembling unit but also the set pin is less prone to inclination. This makes the resilient body less prone to inclination and lateral misalignment. In this way, the inclination of the heat-sensitive disassembling unit is restricted in two spots, that is, by the straight portion of the set pin inserted in the plunger and by the lower-part circumferential surface of the frame. This enables the sprinkler head to reliably ensure activation reliability with greater stability.

Still another feature of the present invention may be that when the guide-receiving portion of the heat-sensitive disassembling unit gets out of the lower-part interior circumferential surface of the frame through the breakdown action, inclination of the heat-sensitive disassembling unit from the set pin is rendered possible.

Once the guide-receiving portion gets out of the lower-part circumferential surface of the frame, the inclination of the heat-sensitive disassembling unit may be tolerated to a certain extent owing to the inclined surface of the set pin. When the guide-receiving portion gets out of the lower-part interior circumferential surface of the frame, the heat-sensitive disassembling unit is farther away from the valve element than it has been before the breakdown action, as a result of the displacement of the heat-sensitive disassembling unit relative to the set pin. The inclined surface, which is closer than the straight portion of the leg of the set pin to the heat-sensitive disassembling unit, is thus located at an interior circumferential end of the plunger. Consequently, the clearance between the leg of the set pin and the interior circumferential surface of the plunger is increased, and inclination of the heat-sensitive disassembling unit is thus rendered possible. The inclination of the heat-sensitive disassembling unit caught on the frame creates a large gap between part of the frame and part of the heat-sensitive disassembling unit. As a result, the heat-sensitive disassembling unit is prompted to fall off from the frame.

That is, in the initial stage of the breakdown action of the heat-sensitive disassembling unit of the sprinkler head, inclination of the heat-sensitive disassembling unit may be restricted. Once the guide-receiving portion gets out of the lower-part interior circumferential surface of the frame, the inclination of the heat-sensitive disassembling unit may be tolerated to a certain extent to prompt the heat-sensitive disassembling unit to fall off from the frame. This enables the sprinkler head to control the inclination of the heat-sensitive disassembling unit and to ensure activation reliability with greater stability.

Still another feature of the present invention may be that an inserted section of the straight portion in the plunger is shorter than the guide-receiving portion.

With the inserted section of the straight portion in the plunger being shorter than the guide-receiving portion, the inclination has already been tolerated when the guide-receiving portion gets out of the lower-part interior circumferential surface of the frame. This enables the heat-sensitive disassembling unit of the sprinkler head to smoothly fall off from the frame.

Still another feature of the present invention may be that before the guide-receiving portion gets out of the lower-part interior circumferential surface of the frame, the straight portion is separated from the interior circumferential surface of the plunger, with inclination of the set pin from the heat-sensitive disassembling unit being rendered possible.

With the inclination of the set pin being tolerated to a certain extent before the heat-sensitive disassembling unit inclines, the heat-sensitive disassembling unit may move more smoothly to fall off from the frame.

Still another feature of the present invention may be that the resilient body is constituted of a plurality of coned disc springs. The set pin is inserted in a first coned disc spring that is one of the plurality of coned disc springs and closer than the other one(s) of the plurality of coned disc springs to the valve element, and the plunger is inserted in a second coned disc spring that is one of the plurality of coned disc springs and closer than the other one(s) of the plurality of coned disc springs to the heat-sensitive disassembling unit.

Reducing the diameter of the coned disc spring in the interest of downsizing the sprinkler head typically causes a decline in the flexure of the coned disc spring, that is, a decline in the pressure which the coned disc spring applies to push the valve element against the nozzle until the heat-sensitive disassembling unit breaks down to fall off from the frame. The sprinkler head according to the aspect above includes more than one coned disc spring to provide a load needed for stoppage of water. A plurality of coned disc springs stacked on one another are typically more prone to lateral misalignment, and the coned disc springs may also be more prone to inclination when the heat-sensitive disassembling unit is in action. However, the heat-sensitive disassembling unit and the coned disc springs of the sprinkler head according to the aspect above are less prone to inclination until the guide-receiving portion gets out of the lower-part interior circumferential surface of the frame, as mentioned above. Once the guide-receiving portion gets out of the lower-part interior circumferential surface of the frame, lateral misalignment and inclination of the coned disc springs are tolerated to promote separation of the heat-sensitive disassembling unit from the frame.

In the initial stage of the breakdown action of the heat-sensitive disassembling unit, inclination of the heat-sensitive disassembling unit may be restricted. Once the restriction is removed, inclination of the heat-sensitive disassembling unit may be tolerated. The present invention thus enables the sprinkler head to ensure activation reliability with greater stability.

BRIEF DESCRIPTION OF THE DRAWINGS

FIG. 2A is a sectional view of the sprinkling portion, and FIG. 2B is a sectional view of the sprinkling portion taken along a dash-dot line in FIG. 2A.

FIG. 4A is a front view of the deflector, and FIG. 4B is a sectional view of the deflector taken along a dash-dot line in FIG. 4A.

FIG. 5A is a sectional view of the guide ring, and FIG. 5B is a bottom view of the guide ring.

FIG. 7A illustrates the sprinkler head prior to activation. FIG. 7B illustrates the state in which solder has melted. FIG. 7C illustrates the state in which the heat-sensitive disassembling unit is falling off. FIG. 7D illustrates in-progress displacement of the sprinkling portion. FIG. 7E illustrates the state in which fire-extinguishing liquid is sprinkled following the completion of activation.

FIG. 8A is an enlarged view of a set pin and a plunger. FIG. 8B is an enlarged view of a frame and a balancer.

DESCRIPTION OF THE PREFERRED EMBODIMENTS

A sprinkler head S according to an aspect of the present invention will be described below by way of embodiments with reference to the accompanying drawings. The wording "first . . . ", "second . . . ", and "third . . . " used herein or in appended claims are intended to make different constituent components of the present invention distinguishable from one another and are not intended to represent a specific order, relative superiority, or the like.

Structure of Sprinkler Head S (FIGS. 1 to 6 and FIGS. 8A and 8B)

Figure 1:
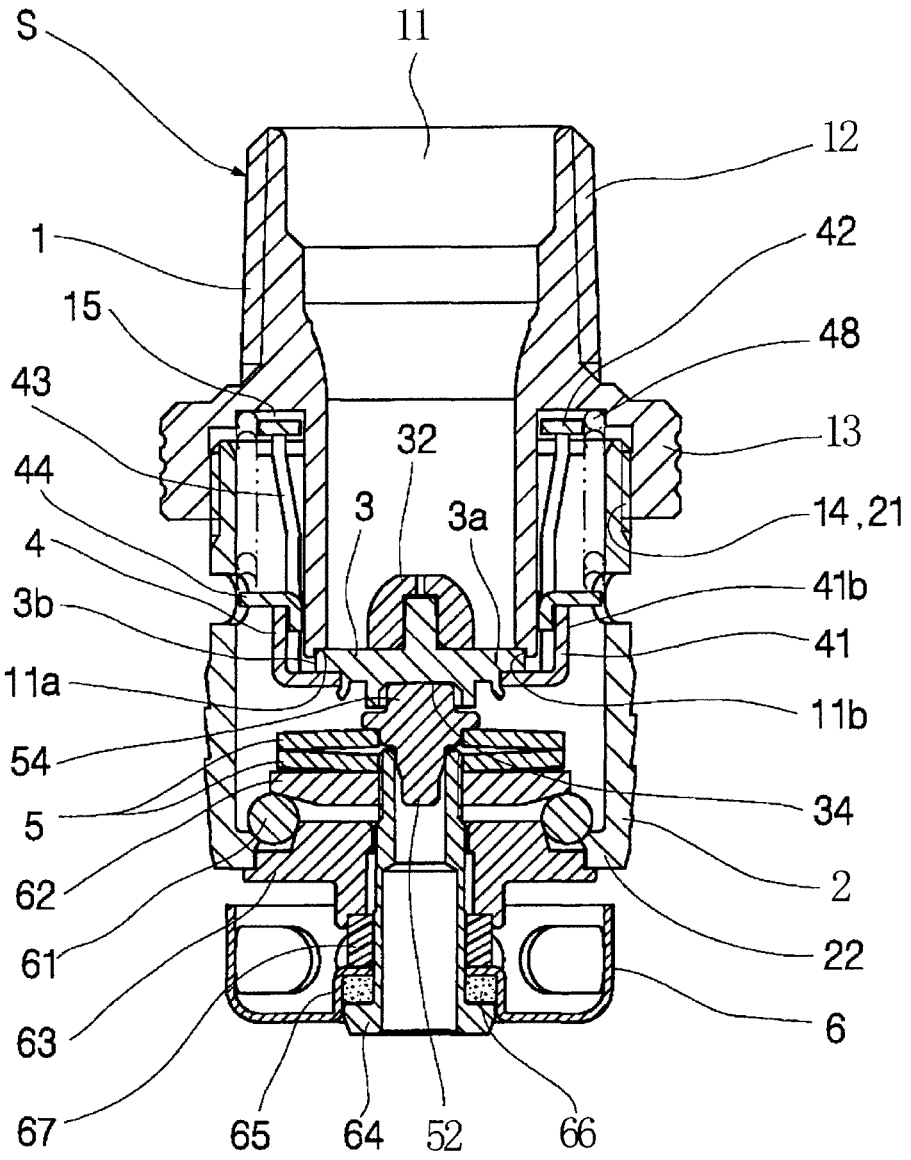
FIG. 1 is a sectional view of a sprinkler head according to an embodiment of the present invention.

The sprinkler head S includes a main body 1, a frame 2, a valve element 3, a sprinkling portion 4, a spring member 5 (a resilient body), and a heat-sensitive disassembling unit 6. As illustrated in FIG. 1, the sprinkler head S has a cylindrical shape. The axial direction of the sprinkler head S corresponds to up-and-down directions in FIG. 1. Directions crossing the axis of the sprinkler head S (axis crossing directions of the sprinkler head S) are radial directions with the axial direction of the sprinkler head S as the center and includes right-and-left directions in FIG. 1.

The main body 1 in the uppermost side in the axial direction of the sprinkler head S and the frame 2 below the main body 1 constitute an exterior part of the sprinkler head S. The valve element 3, the sprinkling portion 4, and the spring member 5 are disposed in the inner space defined by the frame 2. The heat-sensitive disassembling unit 6 is disposed so as to extend over the inside and the outside of the sprinkler head S. Part of the heat-sensitive disassembling unit 6 protrudes downward from the frame 2 in the axial direction of the sprinkler head S. The axes of the constituent components of the sprinkler head S, or more specifically, the axes of the main body 1, the frame 2, the valve element 3, the sprinkling portion 4, the spring member 5, and the heat-sensitive disassembling unit 6 all coincide with the axis of the sprinkler head S.

The main body 1 of the sprinkler head S has a multilayer cylindrical shape. The main body 1 accommodates a nozzle 11, which has a cylindrical shape and extends in the axial direction of the sprinkler head S. That is, the axial direction of the nozzle 11 coincides with the axial direction of the sprinkler head S. The axis (central axis) of the nozzle 11 in its axis crossing directions also coincides with the corresponding axis of the sprinkler head S. The nozzle 11 is a channel of fire-extinguishing liquid (e.g., fire-extinguishing water) sprinkled by the sprinkler head S. The nozzle 11 has a nozzle end 11*a*, which is a lower end and an outlet of the nozzle 11. The fire-extinguishing water is discharged downward from the nozzle end 11*a*. The nozzle end 11*a* is in contact with the valve element 3 in a manner so as to abut against the valve element 3. In ordinary times without an outbreak of fire, the nozzle end 11*a* is closed with the valve element 3.

The main body 1 includes a water-supply pipe connection threaded portion 12, which extends along the exterior circumference of an upper end portion of the main body 1 and is connected to a water-supply pipe (not illustrated) through which fire-extinguishing water is supplied. The main body 1 also includes a flange portion 13, which extends along the exterior circumference of a middle part in the axial direction of the main body 1; that is, the flange portion 13 is located below the water-supply pipe connection threaded portion 12. The flange portion 13 includes a proximal end portion and a cylindrical portion. The proximal end portion is annular-ring shaped and protrudes outward in the axis crossing directions of the sprinkler head S. The cylindrical portion extends from the proximal end portion in a manner so as to be concentric with the nozzle 11. A gap portion 15 is defined between the flange portion 13 and the nozzle 11. The flange portion 13 includes a frame connection threaded portion 14, which extends along an interior circumferential surface of the flange portion 13 and is connected to the frame 2.

Figure 6:
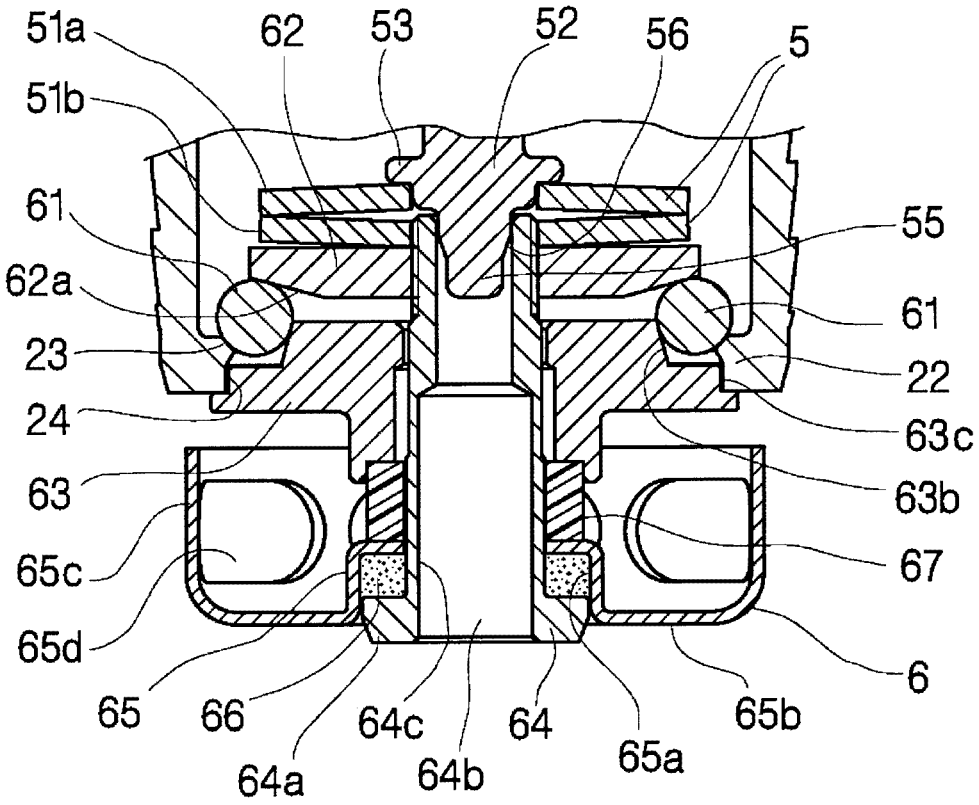
FIG. 6 is an enlarged sectional view of a heat-sensitive disassembling unit in FIG. 1.

The frame 2 has a cylindrical shape. The outside diameter of the frame 2 is substantially equal to the inside diameter of the flange portion 13. The frame 2 includes a main body connection threaded portion 21, which extends along the exterior circumference of an upper end portion of the frame 2 and is connected to the frame connection threaded portion 14. The frame connection threaded portion 14 and the main body connection threaded portion 21, which constitute a coupling part, are fitted together. In this way, the main body 1 and the frame 2 of the sprinkler head S are coupled to each other and are combined into one unit. The frame 2 includes a step portion 22, which extends along the interior circumference of a lower end of the frame 2. The step portion 22 is annular-ring shaped and protrudes inward in the axis crossing directions of the sprinkler head S (see FIGS. 1, 6, 7A, and 8B). The heat-sensitive disassembling unit 6 may be caught in the step portion 22. As illustrated in FIGS. 6, 7C, and 8B, the step portion 22 has an upper inclined surface 23, which is located between an interior circumferential surface and an upper surface of the step portion 22. The upper inclined surface 23 is seemingly obtained by cutting off a corner formed by the interior circumferential surface and the upper surface of the step portion 22. The upper inclined surface 23 is annular-ring shaped. The frame 2 also includes a guide portion 24 (a lower-part interior circumferential surface), which is part of the interior circumferential surface of the step portion 22 and located below the upper inclined surface 23. The guide portion 24 is an annular-ring shaped and is outwardly curved toward the outer side of the frame 2. The guide portion 24 extends along a guide-receiving portion 63*c* on a side surface of a balancer 63, which will be described later.

Figure 2A:
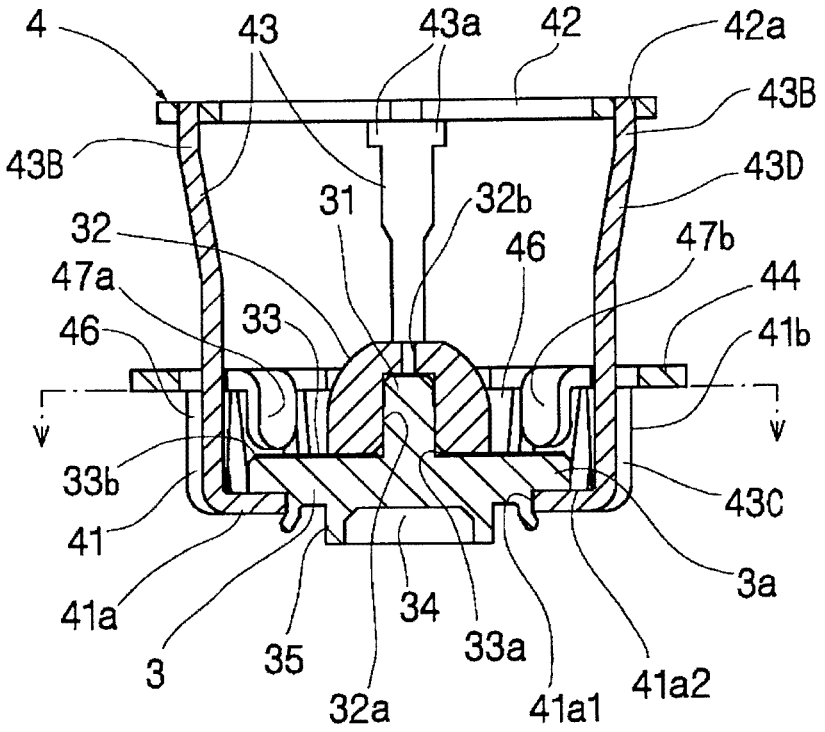
FIGS. 2A and 2B are explanatory drawings of a sprinkling portion of the sprinkler head illustrated in FIG. 1.

The valve element 3 is located between the nozzle 11 and the sprinkling portion 4 and is rotatable with respect to the nozzle 11 and the sprinkling portion 4 about the axis of the sprinkler head S. As illustrated in FIGS. 1 and 2A, the valve element 3 includes a disc 3*a* and a protruding member 32. The disc 3*a* has a discoid shaped (see FIG. 2B). The disc 3*a* includes a peripheral portion 3*b*, which faces the nozzle end 11*a* (see FIG. 1). The axis of the disc 3*a* coincides with the axis of the nozzle 11 (see FIG. 2B). The diameter of the disc 3*a* including the peripheral portion 3*b* is larger than the inside diameter of the nozzle end 11*a* and is smaller than the outside diameter of the nozzle end 11*a* (see FIG. 1). That is, the peripheral portion 3*b* is located between the exterior circumference and the interior circumference of the nozzle end 11*a*. The nozzle 11 has an annular catch groove 11*b*, which is a step portion extending along the interior circumference of a tip of the nozzle 11 (the nozzle end 11*a*).

As illustrated in FIG. 2A, the disc 3*a* is provided with a projection 31 (a columnar portion), which is located on and around the axis of the disc 3*a*. The projection 31 is cylindrical and protrudes toward the inside (upside) of the nozzle 11 (see FIG. 1). The projection 31 is fitted in the protruding member 32 (a holding member). The protruding member 32 in the present embodiment is a dome-shaped molded article of resin. Such a molded article of resin is softer than, for example, metal. The protruding member 32 may thus be easily attached to the disc 3*a*. The protruding member 32 has a disc attachment hole 32*a* (a columnar-portion push-in fitting hole). The projection 31 is pushed from (a lower end of) the valve element 3 along its axis and is fitted into the disc attachment hole 32*a*, in which the projection 31 held accordingly. The protruding member 32 also has a vent 32*b*, which extends from the disc attachment hole 32*a* toward the inside (upside) of the nozzle 11 to form a path connecting the disc attachment hole 32*a* to the external space. When the projection 31 is pushed into the disc attachment hole 32*a*, the air trapped in the disc attachment hole 32*a* can escape through the vent 32*b*. Consequently, the projection 31 may be pushed to come into contact with the innermost wall of the disc attachment hole 32*a*, and the protruding member 32 may be securely fastened to the disc 3*a* accordingly.

In the present embodiment, the projection 31 and the disc attachment hole 32*a*, which constitute a connection portion where the protruding member 32 and the disc 3*a* are connected to each other, are located within the nozzle 11 (see FIG. 1). That is, the projection 31 and the disc attachment hole 32*a* are arranged independently of a contact portion where the nozzle end 11*a* and the valve element 3 are in contact with each other to shut off fire-extinguishing water. Thus, water in the nozzle 11 does not leak out from a gap that can be formed in the connection portion when the degree of connection made by the push-in fitting of the projection 31 in the disc attachment hole 32*a* is slightly lower than expected.

The disc 3*a* is overlaid with a water-stop sheet 33 (a sheet-like water-stop member), which is annular-ring shaped and disposed on an upper surface (a nozzle-side surface) of the disc 3*a*. The water-stop sheet 33 prevents fire-extinguishing water in the nozzle 11 from leaking out from the contact portion where the nozzle end 11*a* (see FIG. 1) and the disc 3*a* are in contact with each other. The water-stop sheet 33 has an annular inside rim 33*a* and an annular outside rim 33*b*. The annular inside rim 33*a* is located on an interior circumferential end in axis crossing directions of the water-stop sheet 33, and the annular outside rim 33*b* is located on an exterior circumferential end in the axis crossing directions of the water-stop sheet 33. The annular inside rim 33*a* defines a projection insertion hole into which the projection 31 is insertable. The annular inside rim 33*a* is located between the disc 3*a* and the protruding member 32. That is, the annular inside rim 33*a* faces a bottom surface of the protruding member 32. The annular outside rim 33*b* is located between the nozzle end 11*a* (see FIG. 1) and the peripheral portion 3*b* (see FIG. 1) of the disc 3*a*. The annular outside rim 33*b* is sandwiched between the annular catch groove 11*b* (see FIG. 1) at the nozzle end 11*a* and the peripheral portion 3*b* of the disc 3*a* and is kept pressed. It is required that the water-stop sheet 33 be disposed so as to be in contact with the nozzle end 11*a*. The outside diameter of the water-stop sheet 33 is equal to or more than the inside diameter of the nozzle 11 and is equal to or less than the outside diameter of the disc 3*a*.

The water-stop sheet 33 in the present embodiment has an adhesive layer formed on a back surface thereof. The adhesive layer is formed from an adhesive. The water-stop sheet 33 is attached to the surface of the disc 3*a* with the adhesive layer therebetween. The region on or close to the annular inside rim 33*a* of the water-stop sheet 33 is held in a manner so as to be sandwiched between the disc 3*a* and the bottom surface of the protruding member 32 and may thus be referred to as a held portion. As the adhesive layer ages, its adhesive strength becomes weaker. However, the water-stop sheet 33 between the disc 3*a* and the protruding member 32 will not come off unless the protruding member 32 is separated from the disc 3*a*. Thus, the water-stop sheet 33 can be stably held on the disc 3*a* irrespective of a reduction in the adhesive strength of the adhesive layer.

The disc 3*a* includes, on a back surface opposite to the nozzle-side surface thereof, a pin-receiving recessed portion 34, which is located in the midsection of the back surface and recessed along (toward the upside of) the nozzle 11. When the pin-receiving recessed portion 34 is pushed upward along its axis, the disc 3*a* is uniformly pressed against the nozzle end 11*a*. The nozzle end 11*a* is closed liquid-tight with the valve element 3 accordingly. The pin-receiving recessed portion 34 is surrounded by a surrounding wall 35, which has a cylindrical shape and is located on the outer side in axis crossing directions of the pin-receiving recessed portion 34. The outside diameter of the cylindrical-shaped surrounding wall 35 is smaller than the outside diameter of the disc 3*a*.

As illustrated in FIG. 2A, the sprinkling portion 4 includes a deflector 41, a support ring 42, struts 43, and a guide ring 44. In ordinary times without an outbreak of fire sensed, that is, before activation of the sprinkler head S, the sprinkling portion 4 is placed in the gap portion 15 located between the nozzle 11 and the frame 2 in the axis crossing directions of the sprinkler head S, as illustrated in FIG. 1.

Figure 2B:
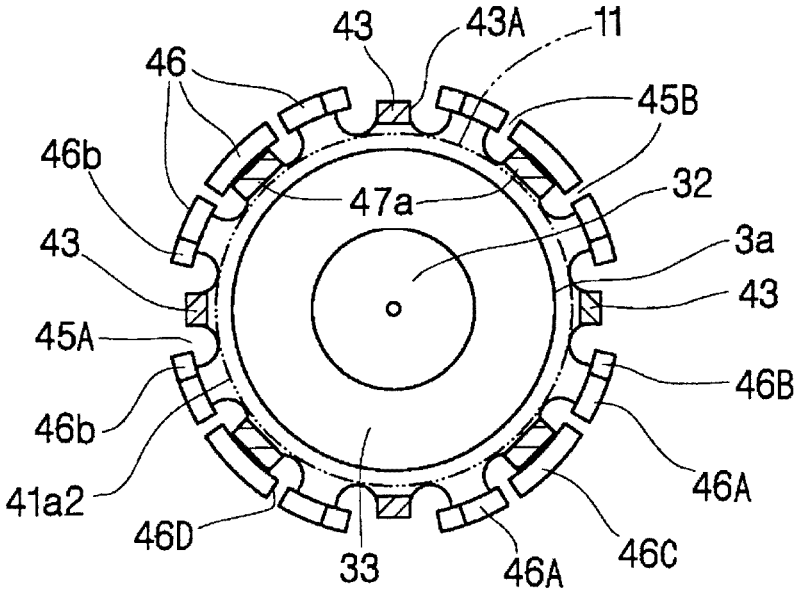

As illustrated in FIGS. 2A and 2B, the deflector 41 has a cylindrical shape with a bottom surface. The outside diameter of the deflector 41 is greater than the outside diameter of the nozzle 11. The deflector 41 includes a valve-element supporting portion 41*a* and vanes 46. The valve-element supporting portion 41*a* is provided as the bottom surface of the deflector 41, and the vanes 46 constitute a side surface of the deflector 41. The valve-element supporting portion 41*a* has an attachment hole 41*a*1, which is located on and around the axis of the valve-element supporting portion 41*a* and extends through the deflector 41 in the axial direction. The surrounding wall 35 of the valve element 3 is rotatably inserted in the attachment hole 41*a*1 in the axial direction of the deflector 41. A portion of the valve element 3 located on the outer side in the axis crossing directions of the valve element 3 with respect to the surrounding wall 35 is placed on an upper surface on the interior circumference side of the valve-element supporting portion 41*a*. The deflector 41 is thus rotatably combined with the valve element 3. The valve-element supporting portion 41*a* includes an annular protruding portion 41*a*2, which protrudes toward the outer side of the peripheral portion 3*b* (see FIG. 1) of the disc 3*a* and is a receiving surface that receives fire-extinguishing water discharged from the nozzle 11. The annular protruding portion 41*a*2 is an inner bottom surface of the deflector 41 and faces the nozzle end 11*a*. Fire-extinguishing water discharged from the nozzle 11 is received by the annular protruding portion 41*a*2 and is temporarily stored within the deflector 41.

It is required that upon the application of heat from the surroundings, the sprinkler head S be activated to cause a breakdown action and sprinkle fire-extinguishing water in all directions with the main body 1 of the sprinkler head S as the center, namely, in the axis crossing directions of the nozzle 11 (the sprinkler head S). In the present embodiment, the breakdown action during the activation of the sprinkler head S is accompanied by displacement of the deflector 41 with respect to the main body 1 and the frame 2. As a result, the deflector 41 is hung from the frame 2, and fire-extinguishing water is sprinkled in all directions accordingly. This placement of the deflector 41 requires the struts 43 engaged with the frame 2.

Specifically, the deflector 41 includes the struts 43 extending along the axis of the sprinkler head S in the direction from the valve-element supporting portion 41*a* (the lower side) toward the main body 1 (the upper side). The struts 43 are disposed on the periphery of the deflector 41 at predetermined spacings. The deflector 41 may be held by the struts 43 in a manner so as to be suspended from above.

Figure 3:
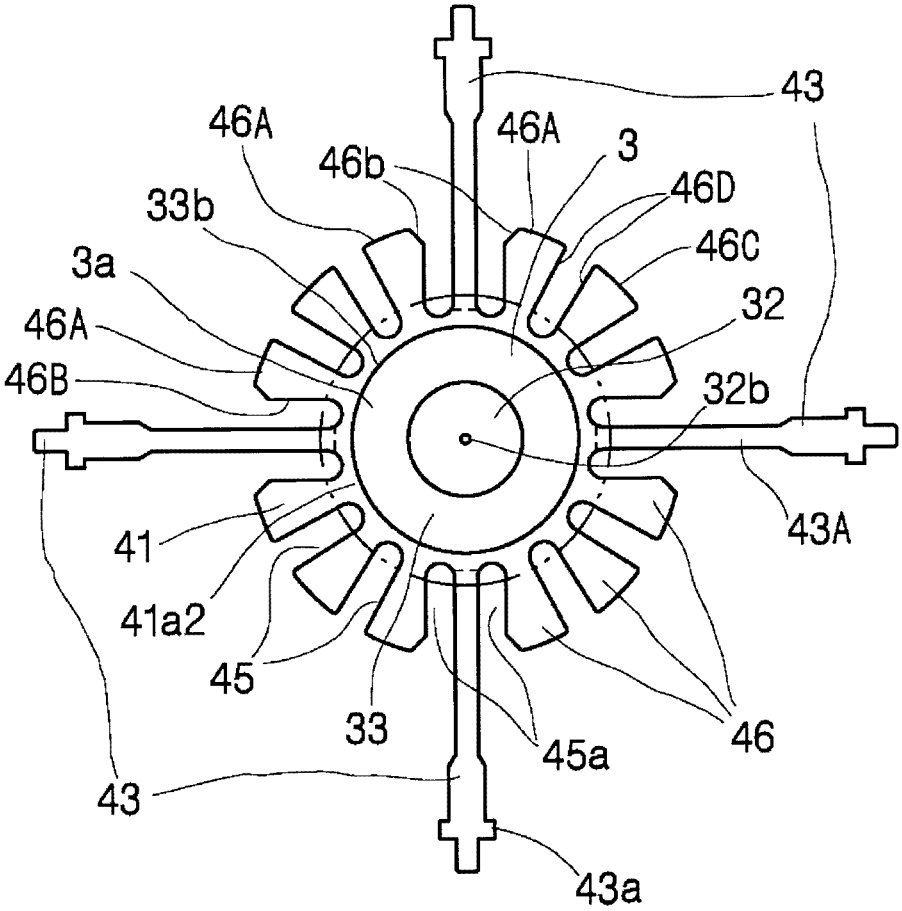
FIG. 3 is a plan view of a deflector in FIG. 1, illustrating the deflector in a developed state before a bending process.

The structure of the deflector 41 may be obtained by bending a metal flat plate. FIG. 3 is a plan view of the deflector 41, illustrating the deflector 41 in a developed state before a bending process. The valve-element supporting portion 41*a* (see FIG. 2A) of the deflector 41 unfolded as a flat plate is circular when viewed in plan. The valve-element supporting portion 41*a* is provided with four struts 43, which extend radially from the annular protruding portion 41*a*2 and are disposed at 90° intervals in the circumferential direction of the valve-element supporting portion 41*a*. The struts 43 are spaced with more than one vane 46 located therebetween. The vanes 46 protrude radially from the annular protruding portion 41*a*2. Each vane 46 is bent at a point close to its proximal end (close to the center of the flat plate viewed in plan) in a manner so as to extend toward the main body 1. The deflector 41 has grooves 45, each of which is formed between the corresponding strut 43 and the vane 46 adjacent thereto or between two adjacent vanes 46. The struts 43 and the vanes 46 are individually linked to the annular protruding portion 41*a*2 accordingly. Each of the struts 43 and the vanes 46 may thus be bent at any position in the corresponding axis crossing direction of the deflector 41 in a manner so as to extend toward the main body 1.

Fire-extinguishing water discharged from the nozzle 11 falls on the protruding member 32 and the annular protruding portion 41*a*2 and is then scattered outward in the axis crossing directions of the nozzle 11 by the vanes 46. As illustrated in FIGS. 2A and 2B, the vanes 46 extending in the axial direction of the nozzle 11 (the sprinkler head S) constitute an outer side surface 41*b* of the deflector 41 in a manner so as to surround the valve element 3. The grooves 45 define liquid flow spaces 45B, each of which is located between two adjacent vanes 46 (see FIGS. 4A and 4B).

Figure 4A:
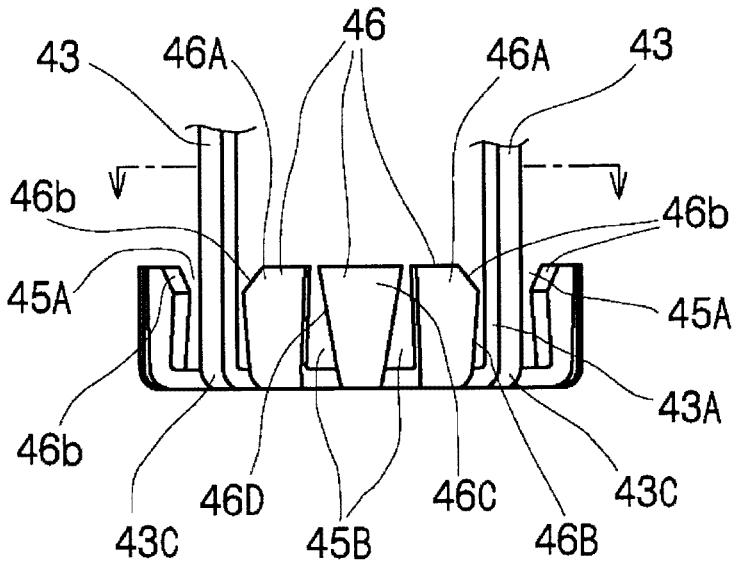
FIGS. 4A and 4B are explanatory drawings of the deflector in FIG. 1, illustrating vanes and struts of the deflector.
Figure 4B:
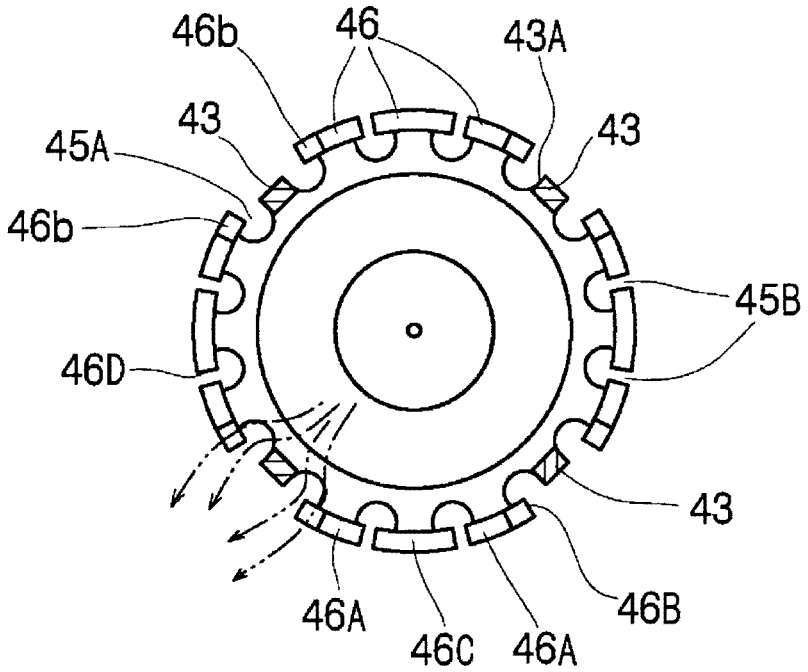

As with the vanes 46, each strut 43 in FIG. 3 is bent at a point close to its proximal end. The struts 43 of the deflector 41 extend toward the main body 1 accordingly. The bending points of the struts 43 close to the proximal ends thereof are indicated by broken lines in FIG. 3. The bending positions of the vanes 46 close to the proximal ends thereof are indicated by a dash-dot-dot line in FIG. 3. The bending positions of the struts 43 are closer than the bending positions of the vanes 46 to the axis of the deflector 41. As illustrated in FIG. 4B, the positions where the struts 43 extend toward the main body 1 from the valve-element supporting portion 41*a* (see FIG. 2A) of the deflector 41 are thus closer to the axis of the sprinkler head S so as not to coincide with the positions of the vanes 46 in the axis crossing directions of the sprinkler head S. The struts 43 are located on the inner side with respect to the outer side surface 41*b* of the deflector 41 accordingly.

As mentioned above, a feature of the sprinkler head S is that the struts 43 (the bending positions of the struts 43) are closer than the vanes 46 (the bending positions of the vanes 46) to the axis of the deflector 41. Owing to this feature, fire-extinguishing water discharged from the nozzle 11 splatters on the valve element 3 and flows through the annular protruding portion 41*a*2 of the deflector 41, and each flow of extinguishing water passes through side edges of any one of the struts 43 and is then guided by the vanes 46 adjacent to the strut 43 to flow to the back side of the strut 43 (toward the outer side surface 41*b*).

The following describes a comparative example in which the bending positions of the struts 43 coincide with the bending positions of the vanes 46, namely, the positions indicated by the dash-dot-dot line in FIG. 3. The struts 43 and the vanes 46 constitute an interior circumferential surface that is continuous and does not have steps in the axis crossing directions of the deflector 41, and the struts 43 are walls taller than the vanes 46. The amount of fire-extinguishing water flowing to the back side of the struts 43 may thus be insufficient. As a result, there will be a shortage of extinguishing water that will be sprinkled on the back side of the struts 43.

As to the sprinkler head S according to the present embodiment, the struts 43 are closer than the vanes 46 to the axis of the deflector 41, with a step being formed between each strut 43 and each vane 46 in the corresponding axis crossing direction of the sprinkler head S. The steps enable fire-extinguishing water to flow to the back side of the struts 43. Dash-dot-dot lines in FIG. 4B denote paths of fire-extinguishing water. In this way, the amount of fire-extinguishing water that will be sprinkled on the back side of the struts 43 may be increased. The deflector 41 can thus get over the relative shortage of fire-extinguishing water on the back side of the struts 43, which would otherwise hold back flows of fire-extinguishing water. This enables the sprinkler head S to sprinkle fire-extinguishing water uniformly from all around its edges.

The structure of the vanes 46 may be refined to achieve a further increase in the amount of fire-extinguishing water that will be sprinkled on the back side of the struts 43. As illustrated in FIGS. 3, 4A, and 4B, the vanes 46 include first vanes 46A, each of which is adjacent to the corresponding strut 43 in the circumferential direction of the deflector 41 and has a first side edge portion 46B facing the strut 43. As illustrated in FIG. 4A, the first side edge portion 46B includes a corner-trimmed edge part 46*b*, where a corner on the main body 1 side is trimmed off. The first vane 46A including the corner-trimmed edge part 46*b* offers an advantage in that an expanded path 45A is formed between the strut 43 and (the corner-trimmed edge part 46*b* of) the first side edge portion 46B of the first vane 46A on the main body side; that is, the expanded path 45A is wider than a path that would be formed between the strut 43 and a vane without the corner-trimmed edge part 46*b*. Fire-extinguishing water discharged from the nozzle 11 and collected in the deflector 41 can easily flow to the back side of the strut 43 through the corner-trimmed edge part 46*b* (the expanded path 45A), which is a low-lying region (with a low water level above the valve-supporting portion 41*a*). The deflector 41 thus enables a further increase in the amount of fire-extinguishing water that will be sprinkled on the back side of the struts 43.

The corner-trimmed edge part 46*b* mentioned above is a region where a corner is linearly cut at a bevel. Alternatively, the corner-trimmed edge part 46*b* may be a region where a corner is cut, for example, in the form of an arc or a step.

The vanes 46 include second vanes 46C, each of which is adjacent to other ones of the vanes 46 in the circumferential direction of the deflector 41. Each second vane 46C has second side edge portions 46D, which face the other ones of the vanes 46 and extend from the valve-element supporting portion 41*a* side toward the main body 1. As illustrated in FIG. 4A, the distance between each of the second side edge portions 46D and the corresponding adjacent vane 46 is shorter on the main body 1 side than on the valve-element supporting portion 41*a* side. Thus, the liquid flow space 45B provided for fire-extinguishing water by two adjacent vanes 46 is wedge-shaped (reverse tapered); that is, the liquid flow space 45B is progressively narrowed toward the main body 1 and is progressively broadened toward the valve-element supporting portion 41*a*, namely, the inner bottom surface of the deflector 41.

The liquid flow space 45B on the inner bottom surface (the lower side) of the deflector 41 provides a wide path for fire-extinguishing water, which will in turn be sprinkled over relatively short distances in the axis crossing directions of the sprinkler head S. The other part of the liquid flow space 45B adjacent to (the upper part of) the vanes 46 on the main body 1 side provides a narrow path for fire-extinguishing water. The amount of sprinkled water may thus be reduced, and the water level in the deflector 41 rises accordingly. Consequently, fire-extinguishing water overflows the vanes 46. Fire-extinguishing water overflowing the vanes 46 is in a position (surface layer) where the flow is less affected by the friction between fire-extinguishing water and the valve-element supporting portion 41*a*, namely, the bottom of the flow path, and as a result, the flow speed is relatively high. Furthermore, fire-extinguishing water overflowing the vanes 46 on the main body 1 side is less affected by the liquid flow spaces 45B. Fire-extinguishing water overflowing (the upper part of) the vanes 46 on the main body 1 side will thus be sprinkled over long distances in the axis crossing directions of the sprinkler head S. This enables the sprinkler head S to sprinkle fire-extinguishing water uniformly over long distances and short distances in the axis crossing directions.

Another conceivable design of the vane 46 is as follows: part of the second side edge portion 46D extends perpendicularly from the (upper) surface of the valve-element supporting portion 41*a* on the main body 1 side to about half the height of the vane 46, from where the upper part of the vane 46 is progressively broadened toward the main body 1. In this case, the flow of fire-extinguishing water is affected more by the liquid flow spaces 45B as in the case mentioned above.

Still another conceivable design of the vane 46 is as follows: the liquid flow space 45B illustrated in FIG. 4A maintains a constant width both on the main body 1 side and on the valve-element supporting portion 41*a* side; that is, the side edge portions of two adjacent vanes 46 are in parallel. This design causes an increase in the amount of fire-extinguishing water flowing through the liquid flow spaces 45B, as compared with the design in the present embodiment. The amount of fire-extinguishing water overflowing the vanes 46 declines correspondingly. As a result, the amount of fire-extinguishing water that will be sprinkled over short distances from the sprinkler head S will rise, and the amount of fire-extinguishing water that will be sprinkled over long distances from the sprinkler head S will decline. Yet still another conceivable design of the vane 46 is as follows: the upper part of the fluid flow space 45B adjacent to the vane 46 on the main body 1 side is wide, and the lower part of the fluid flow space 45B adjacent to the vane 46 on the valve-element supporting portion 41*a* side is narrow. In this case, the flow of fire-extinguishing water may be affected much more by the liquid flow spaces 45B, and the amount of fire-extinguishing water overflowing the tips of the vanes 46 may decline. This is likely to cause a further decrease in the amount of fire-extinguishing water that will be sprinkled over long distances from the sprinkler head S.

Each strut 43 has third side edge portions 43A, which extend from the valve-element supporting portion 41*a* side toward the main body 1. A deflector known in the art may be obtained in the following manner: target sites of a metal flat plate that are to be formed into the struts 43 and the vanes 46 are bent in such a manner that the third side edge portions 43A, the first side edge portions 46B, and the second side edge portions 46D extend parallel to the axis of the deflector 41. This requires the following design: when the struts 43 and the vanes 46 are unfolded as illustrated in FIG. 3, the third side edge portions 43A of the struts 43 and the first side edge portions 46B of the vanes 46 extend radially, with the space therebetween being progressively broadened from the interior circumference toward the exterior circumference of the flat plate. In other words, it is required that the grooves 45 and grooves 45*a* each have the shape of a sector or a rounded-corner triangle.

In the present embodiment, meanwhile, each of the first side edge portions 46B extends parallel to the corresponding one of the third side edge portions 43A when the struts 43 and the vanes 46 are unfolded as a flat plate as illustrated in FIG. 3. In other words, each of the grooves 45*a* adjacent to the struts 43 is U-shaped and extends parallel to the corresponding strut 43 and the corresponding first vane 46A. The same holds true for the grooves 45, each of which is adjacent to two second side edge portions 46D. The struts 43 and the vanes 46 on the exterior circumference side of the flat plate may be bent to form fire-extinguishing water paths that are wide on the valve-element supporting portion 41*a* side and are narrow on the main body 1 side, as illustrated in FIG. 4A. This enables the sprinkler head S to sprinkle fire-extinguishing water more uniformly over long distances and short distances in the axis crossing directions.

As illustrated in FIG. 1, the peripheral portion 3*b* of the disc 3*a* of the valve element 3 is discretely located away from the struts 43 and the vanes 46 (see FIG. 2A). This eliminates or reduces the possibility that misalignment will be produced between the valve element 3 and the nozzle 11 as a result of any impact on the sprinkler head S. The tip of the nozzle 11 is located between each vane 46 and the exterior circumference of the disc 3*a*. The sprinkler head S configured as described above ensures that the space for the tip of the nozzle 11 is left between the peripheral portion 3*b* of the valve element 3 and the vanes 46.

The support ring 42 has a shape of an annular-ring flat plate. The outside diameter and the inside diameter of the support ring 42 are greater than those of the nozzle 11. The struts 43 are secured with the support ring 42. As illustrated in FIG. 2A, the support ring 42 has catch holes 42*a*, which are through holes extending in the axial direction of the sprinkler head S. The sprinkler head S is assembled by inserting the struts 43 into the catch holes 42*a*. The struts 43 are secured with the support ring 42, which reinforces the struts 43 accordingly. Furthermore, the support ring 42 moves with the struts 43 during the displacement of the deflector 41. The deflector 41 and the struts 43 may thus be less prone to inclination during displacement. It is not always required that the support ring 42 be annular-ring shaped so as to extend along the entire circumference of the sprinkler head S. The support ring 42 may be arc-shaped so as to secure adjacent ones of the struts 43 or may be shaped like a half-annular ring.

Main-body-side end portions 43B, which are tips of the struts 43, are fixed to the support ring 42 having a shape of an annular-ring flat plate. As illustrated in FIG. 2A, each strut 43 includes, on the main body 1 side thereof, a wide portion whose width (dimension) in the circumferential direction of the deflector 41 is greater than that of the other part the strut 43 on the valve-element supporting portion 41*a* side (see FIG. 3). Each strut 43 includes a collar portion 43*a*, which is closer than the wide portion to the main body 1 and protrudes toward opposite sides in the circumferential direction. Portions of the struts 43 closer than the collar portions 43*a* to the main body 1 are inserted in the respective catch holes 42*a* of the support ring 42, and a lower surface of the support ring 42 is held by the collar portions 43*a* accordingly. The main-body-side end portions 43B of the struts 43 are fastened to the support ring 42 by staking. The struts 43 may be attached to the support ring 42 by any means that enables the support ring 42 to hold the struts 43.

As illustrated in FIG. 2A, the guide ring 44 (see FIGS. 5A and 5B) is attached to the deflector 41. The guide ring 44 has a shape of an annular-ring flat plate, and the outside diameter of the guide ring 44 is smaller than the inside diameter of the frame 2. The guide ring 44 is disposed so as to be movable along the struts 43 and between the main-body-side end portion 43B of each strut 43 and the tips of the vanes 46. When the heat-sensitive disassembling unit 6 falls off from the main body 1 and causes displacement of the deflector 41 and the struts 43, the guide ring 44 movable along the struts 43 holding the deflector 41 restricts lateral misalignment and inclination of the deflector 41 and the struts 43. This makes it certain that the deflector 41 moves to a predetermined position for sprinkling fire-extinguishing water, that is, to the outside of the lower part of the frame 2 when the sprinkler head S is activated.

Figure 5A:
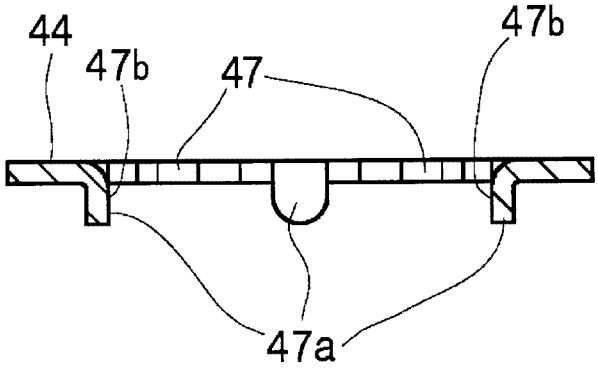
FIGS. 5A and 5B are explanatory drawings of a guide ring in FIG. 1.
Figure 5B:
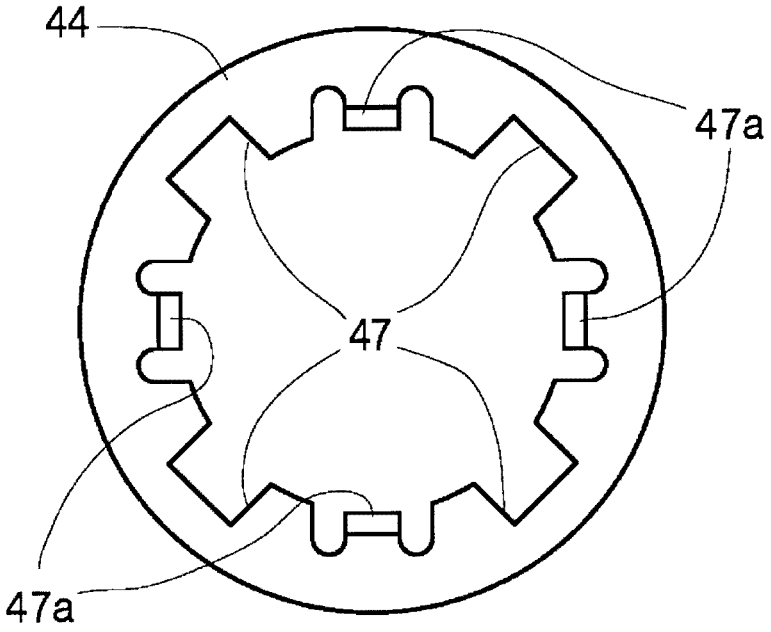

The guide ring 44 includes guide recessed portions 47, which guide the struts 43 in a manner so as to be out of the way of the struts 43 moving in the axial direction of the nozzle 11. As illustrated in FIG. 5B, the guide recessed portions 47 are provided on an interior circumferential edge portion of the guide ring 44, where the guide recessed portions 47 are seemingly obtained by cutting off rectangular plate segments extending outward in the axis crossing directions of the sprinkler head S when viewed in plan. This enables the struts 43 to move along the guide recessed portions 47 of the guide ring 44 when the heat-sensitive disassembling unit 6 falls off from the main body 1 and causes the deflector 41 to move in the axial direction of the nozzle 11. The guide recessed portions 47 eliminate or reduce the possibility that the guide ring 44 will become a hindrance to the struts 43 during the displacement of the deflector 41.

Referring to FIG. 5B, four guide recessed portions 47 are spaced uniformly in the circumferential direction of the guide ring 44. As illustrated in FIGS. 2A and 5A, the guide ring 44 is provided with claws 47*a*, each of which is located between two adjacent guide recessed portions 47 and is bent down toward the disc 3*a* to form a right angle with the plane on which the guide ring 44 lies. As illustrated in FIG. 2B, each claw 47*a* is disposed between the corresponding vane 46 and an exterior circumferential surface of the nozzle 11 denoted by a dash-dot-dot line in FIG. 2B. Each claw 47*a* between the nozzle 11 and the corresponding vane 46 thus eliminates or reduces the possibility that the deflector 41 will be off center with respect to the nozzle 11.

Each claw 47*a* has a flat surface 47*b*, which faces the nozzle 11 and slides over the exterior circumferential surface of the nozzle 11 when the sprinkler head S is activated. That is, the claws 47*a* on the guide ring 44 are slidable over the nozzle 11 in a manner so as to have surface contact with the nozzle 11; that is, the claws 47*a* are slidable over the nozzle 11 with the flat surfaces 47*b* contacting the exterior circumferential surface of the nozzle 11. This makes the guide ring 44 less prone to lateral misalignment and inclination with respect to the nozzle 11. The sprinkling portion 4 can thus move smoothly without an exterior circumferential edge of the guide ring 44 getting snagged on an interior circumferential surface of the frame 2.

The flat planes 47*b* of the claws 47*a* each have a shape composed of a rectangular upper part and a semicircular lower part; that is, an end of each claw 47*a* on the disc 3*a* side is rounded in the form of a semicircle. When the sprinkler head S is activated to cause the guide ring 44 to descend, the claws 47*a* can possibly come into contact with the frame 2 or the nozzle 11. However, owing to the rounded ends, the claws 47*a* are less likely to get snagged on the frame 2 or the nozzle 11.

The guide ring 44 is placeable on the vanes 46. This enables a reduction in the space for a coil spring 48, which will be described later, and the overall length of the sprinkler head S in its axial direction may thus be short. The claws 47*a* hang down toward the disc 3*a*. The guide ring 44 may thus be stable on the vanes 46 and may be easily positioned on a target site accordingly.

It is not always required that the guide ring 44 be annular-ring shaped so as to extend along the entire circumference of the sprinkler head S. The guide ring 44 may include four arc-shaped segments corresponding to the four struts 43 or may be shaped like a half-annular ring. The guide ring 44 is preferably annular-ring shaped so as to extend along the entire circumference, where the guide ring 44 can maintain balance and is less likely to incline during displacement.

The struts 43 are inserted into the guide ring 44 before being combined with the support ring 42. The struts 43 are received in the respective guide recessed portions 47.

Instead of being provided on the interior edge portion of the guide ring 44, the guide recessed portions 47 may be provided on an exterior edge portion of the guide ring 44, where the guide recessed portions 47 are seemingly obtained by cutting off segments extending inward in the axis crossing directions of the sprinkler head S. In this case, the coil spring 48, which will be described layer, is disposed so as to be adjacent to the interior edge portion of the guide ring 44.

Each strut 43 includes a bent portion 43D, which is the middle part in the longitudinal direction of the strut 43. With the bent portion 43D being provided, the upper end of the strut 43, namely, the main-body-side end portion 43B is located on the outer side in the axis crossing direction of the deflector 41 with respect to a deflector-side end portion 43C, which is the lower end of the strut 43. This means that the upper part of the strut 43 adjacent to the main body 1 is located on the outer side in the axis crossing direction of the deflector 41 with respect to the other part of the strut 43. Thus, the distance between each strut 43 and the guide ring 44 is wide on the valve-element supporting portion 41*a* side and is narrow on the main body 1 side. When the heat-sensitive disassembling unit 6 falls off from the main body 1, the deflector 41 starts moving along the nozzle 11. In the initial stage of the displacement, a wide clearance between each strut 43 and the corresponding guide recessed portion 47 enables the guide ring 44 to move (slide) smoothly along the strut 43. In the last stage of the displacement, a narrow clearance between each strut 43 and the corresponding guide recessed portion 47 enables the guide ring 44 to restrict lateral misalignment and inclination of the deflector 41.

It is only required that the main-body-side end portion 43B of each strut 43 be located on the outer side in the axis crossing direction of the deflector 41 with respect to the corresponding deflector-side end portion 43C. Each strut 43 may include, in place of the bent portion 43D, a straight slope formed between the main-body-side end portion 43B and the deflector-side end portion 43C.

The support ring 42, the struts 43, and the guide ring 44 are disposed in the gap portion 15 between the exterior circumference of the nozzle 11 and the interior circumference of the frame 2. The coil spring 48 (an elastic member) is attached between the guide ring 44 and the main body 1. The coil spring 48 is disposed on the exterior circumferential edge of the guide ring 44. As illustrated in FIG. 1, the support ring 42 and the struts 43 are disposed within the interior circumference of the coil spring 48.

Another conceivable layout is as follows: the coil spring 48 is disposed between the main body 1 and the tip (the main-body-side end portion 43B) of each strut 43. A disadvantage of this layout is that the sprinkler head S is extended in its axial direction, with the coil spring 48 being in line with the struts 43 (with the coil spring 48 and each strut 43 being aligned on the same axis). In the present embodiment, meanwhile, the sprinkler head S has, on the outer side with respect to the struts 43 and the support ring 42, the space (the gap portion 15) in which the coil spring 48 is juxtaposed with the struts 43, and the overall length of the sprinkler head S in its axial direction may thus be short.

The coil spring 48 exerts force on the guide ring 44, through which the deflector 41 is pushed downward in the axial direction of the nozzle 11 in a manner so as to move away from the main body 1. The load applied by the coil spring 48 is imposed on the deflector 41 and the valve element 3 accordingly. When the heat-sensitive disassembling unit 6 falls off from the main body 1, the load can reject negative pressure, if any, in the nozzle 11, and the valve element 3 may be detached from the nozzle 11 to open the nozzle end 11*a*. The sprinkler head S is therefore applicable to a vacuum sprinkler system where negative pressure is generated inside the nozzle 11.

The spring member 5 exerts force on the valve element 3, which in turn is pushed toward the nozzle 11 to close the nozzle end 11*a*. Referring to FIG. 1, the spring member 5 may be coned disc springs 51, which are made of metal. As illustrated in FIG. 6, one of the coned disc springs 51 is a coned disc spring 51*a* (a first coned disc spring), and the other one the coned disc springs 51 is a coned disc spring 51*b* (a second coned disc spring). The coned disc spring 51*a* is located on the inner side with respect to the frame 2 and on the upper side in the axial direction of the sprinkler head S, and the coned disc spring 51*b* is located on the inner side with respect to the frame 2 and on the lower side in the axial direction of the sprinkler head S. The outside diameter of each of the coned disc springs 51*a* and 51*b* is substantially equal to the outside diameter of the valve-element supporting portion 41*a* of the deflector 41. The coned disc springs 51*a* and 51*b* are stacked in a series arrangement, with their circumferential edges coinciding with each other. The coned disc springs 51*a* and 51*b* each have a hole in which a set pin 52 is inserted. The set pin 52 is cylindrical and inserted into the holes from above in the axial direction of the sprinkler head S. The coned disc springs 51*a* and 51*b* and the set pin 52 are disposed between the valve element 3 and the heat-sensitive disassembling unit 6.

Reducing the diameter of the coned disc spring 51 in the interest of downsizing the sprinkler head S typically causes a decline in the flexure of the coned disc spring 51, that is, a decline in the pressure which the coned disc spring 51 applies to push the valve element 3 against the nozzle 11 until the heat-sensitive disassembling unit 6 breaks down to fall off from the frame 2. The sprinkler head S according to the present embodiment includes more than one coned disc spring 51 to provide a load needed for stoppage of water. The coned disc springs 51 stacked on one another are typically more prone to lateral misalignment, and the coned disc springs 51 may also be more prone to inclination when the heat-sensitive disassembling unit 6 is in action. However, the heat-sensitive disassembling unit 6 and the coned disc springs 51 of the sprinkler head S according to the present embodiment are less prone to inclination until the guide-receiving portion 63*c* gets out of the guide portion 24 of the frame 2, as will be described later. Once the guide-receiving portion 63*c* gets out of the guide portion 24 of the frame 2, lateral misalignment and inclination of the coned disc springs 51 are tolerated to promote separation of the heat-sensitive disassembling unit 6 from the frame 2.

Figure 8A:
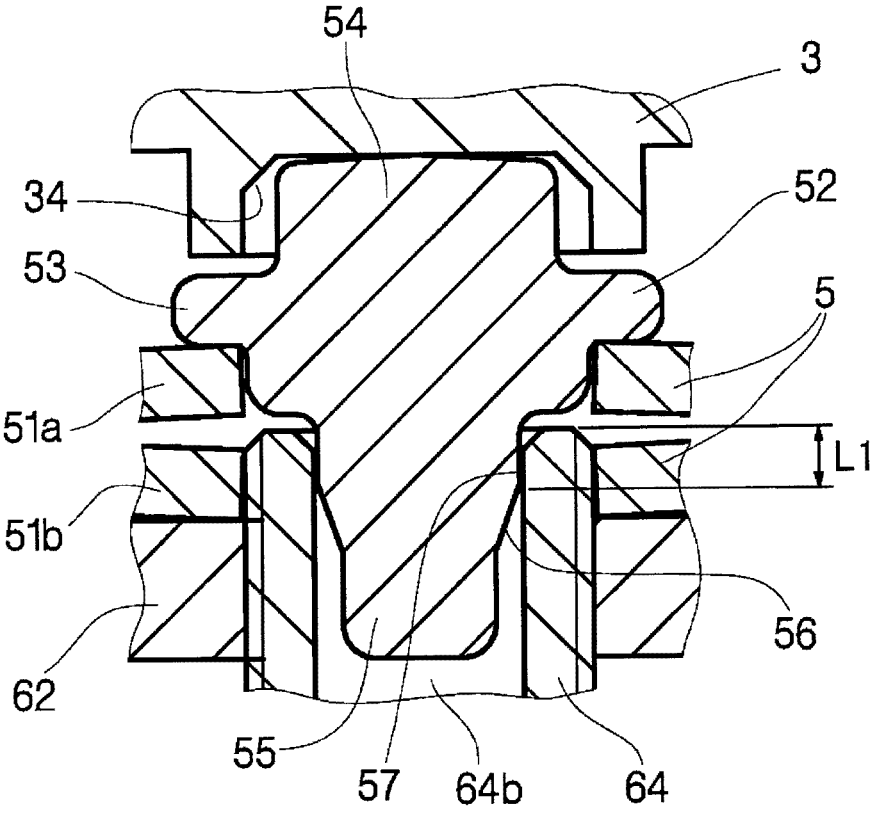
FIGS. 8A and 8B are enlarged views of principal part of the heat-sensitive disassembling unit in FIG. 1.

As illustrated in FIG. 8A, the set pin 52 includes a flange 53, which is on the middle part of the set pin 52 in its axial direction. The flange 53 is annular-ring shaped so as to extend along the exterior circumference of the middle part of the set pin 52 and protrudes outward. The flange 53 is disposed so as to be in contact with an interior edge portion of an upper surface of the coned disc spring 51*a*. The set pin 52 also includes a head portion 54, which is an upper end in the axial direction of the set pin 52 and insertable into the pin-receiving recessed portion 34. The head portion 54 has a curved top (upper) surface, which enables the head portion 54 to press the pin-receiving recessed portion 34 while maintaining point contact with a flat surface of the pin-receiving recessed portion 34, that is, while being in contact with the flat surface solely at the center in axis crossing directions of the pin-receiving recessed portion 34. Thus, a feature of the sprinkler head S is that the coned disc springs 51 exert bias force on the flange 53 and the head portion 54, which in turn apply a pressure load to the center of the flat surface of the pin-receiving recessed portion 34, that is, to the axis of the valve element 3. This feature enables the sprinkler head S to securely close the nozzle end 11*a* by uniform application of load to the peripheral edge portion of the valve element 3 in its axis crossing directions (see FIG. 1).

As illustrated in FIG. 8A, the set pin 52 includes a small-diameter portion 55, which is a lower end of the set pin 52 in its axial direction. The dimension of the small-diameter portion 55 from the axis of the set pin 52 is smaller than that of the other part of the set pin 52. The set pin 52 has an inclined surface 56, which is closer than the small-diameter portion 55 to the valve element 3 with an increase in the diameter of the set pin 52 in an upward direction. The set pin 52 also includes a straight portion 57, which is closer than the inclined surface 56 to the valve element 3 and extends in the axial direction of the set pin 52 with a fixed dimension from the axis of the set pin 52. The small-diameter portion 55, the inclined surface 56, and the straight portion 57 constitute a leg of the set pin 52.

As illustrated in FIG. 1, the heat-sensitive disassembling unit 6 includes balls 61, a slider 62, the balancer 63, a plunger 64, and a cylinder 65. The heat-sensitive disassembling unit 6 keeps the nozzle 11 closed with the valve element 3. The heat-sensitive disassembling unit 6 opens the nozzle through a breakdown action during activation of the sprinkler head S.

As illustrated in FIG. 6, the balls 61 are spheres made of steel and are of the same size. As may also be seen in FIG. 8B, each ball 61 is disposed in such a manner that a lower part thereof is in contact with the upper inclined surface 23 of the step portion 22 of the frame 2.

The slider 62 has a shape of an annular-ring flat plate. The outside diameter of the slider 62 is substantially equal to the outside diameter of each of the coned disc springs 51*a* and 51*b*. The slider 62 is disposed so as to be in contact with an interior edge portion of a lower surface of the coned disc spring 51*b*. The slider 62 includes holding recessed portions 62*a*, which extend along a peripheral edge of a lower surface of the slider 62. Each holding recessed portion 62*a* has a slope with a progressive decrease in the plate thickness toward the peripheral edge of the slider 62. The number of the holding recessed portions 62*a* is the same as the number of the balls 61. The holding recessed portions 62*a* are spaced uniformly in the circumferential direction of the slider 62. Each of the balls 61 is received in the corresponding one of the holding recessed portions 62*a*.

The coned disc spring 51*b* exerts bias force on the slider 62, which in turn presses the balls 61 from above. With the balls 61 being in contact with the upper inclined surface 23, force acts on the balls 61 all the time in a manner so as to shift the balls 61 downward and toward the axis of the sprinkler head S. The balls 61 are spaced uniformly in the circumferential direction of the slider 62, and a pressure load is uniformly imposed on the balls 61 accordingly. This arrangement prevents or reduces the concentration of the pressure load in one or more components and may thus prevent the occurrence of damage to the components. This arrangement also eliminates or reduces the possibility that nonuniformity in the pressure load will be produced to cause inclination of the slider 62. The spring member 5 on the slider 62 applies a closing load for closing the nozzle end 11*a* to the set pin 52, which in turn transmits the load to the axis of the valve element 3. Consequently, the closing load is uniformly imposed on the nozzle end 11*a*, and liquid leakage from the nozzle 11 may be prevented accordingly.

The slider 62 has, on and around the axis thereof, a hole with an internal screw thread. In the inner space defined by the frame 2, the plunger 64 with the balancer 63 and the cylinder 65 attached thereto is fitted to the spring member 5, the set pin 52, and the slider 62 provided with the balls 61. This causes the spring member 5 to exert bias force on the valve element 3 so that the nozzle end 11*a* is closed with the valve element 3. The heat-sensitive disassembling unit 6 is fitted to the frame 2 while being pressed downward.

The balancer 63 has a cylindrical shape, and the outside diameter of the balancer 63 is greater than the outside diameter of the slider 62. The balancer 63 includes a step portion 63*b*, where a peripheral part of an upper surface of the balancer 63 is trimmed off in the form of an annular ring. While force is acting on the balls 61 in a manner so as to shift the balls 61 downward and toward the axis of the sprinkler head S, the balls 61 are in contact with an exterior surface of the step portion 63*b* of the balancer 63 and may thus be prevented from moving. The balls 61 are held still by the balancer 63, and the heat-sensitive disassembling unit 6 and the frame 2 are joined together accordingly. The balancer 63 has, on and around the axis thereof, a through-hole into which the plunger 64 is insertable.

The guide-receiving portion 63*c* is on a side surface of the balancer 63 and faces the guide portion 24 of the frame 2. The guide-receiving portion 63*c* is slidable over the guide portion 24. The guide-receiving portion 63*c* slides over the guide portion 24 in the initial stage of the action of the heat-sensitive disassembling unit 6 and is thus capable of preventing or reducing the inclination of the heat-sensitive disassembling unit 6.

The plunger 64 is cylindrical. The outside diameter of the plunger 64 is substantially equal to the inside diameter of the slider 62. The plunger 64 is longer in the axial direction than in the axis crossing directions of the sprinkler head S. The plunger 64 has an upper end with an external screw thread extending along the exterior circumference thereof and provided for connection with the slider 62. When being connected with the slider 62, the plunger 64 extends through the hole of the coned disc spring 51*b* stacked on the slider 62. It is preferred that the distance between an upper surface of the slider 62 and an upper end of the plunger 64 connected with the slider 62 be equal to or slightly greater than the thickness of the coned disc spring 51*b*. The coned disc spring 51*b* is thus kept supported and prevented from slipping through the plunger 64 when the heat-sensitive disassembling unit 6 goes into action to fall off from the frame 2.

The plunger 64 includes a collar portion 64*a*, which is at a lower end of the plunger 64 and is annular-ring shaped so as to protrude outward in the axis crossing directions of the sprinkler head S. The collar portion 64*a* has an upper surface overlaid with a low-melting alloy 66, which is ring-shaped. The cylinder 65 is attached to the plunger 64 in a manner so as to cover and catch the low-melting alloy 66 lying over the collar portion 64*a*.

The cylinder 65 has a cylindrical shape with a bottom. The outside diameter of the cylinder 65 is substantially equal to the outside diameter of the frame 2. The cylinder 65 is formed from a highly thermally conductive material, such as copper or a copper alloy, and heat absorbed from a surface of the cylinder 65 may thus be conducted well to the low-melting alloy 66. The cylinder 65 has, on and around the axis thereof, a dent 65*a*, where a lower (bottom) part the cylinder 65 is dented upward. The low-melting alloy 66 is fitted between the dent 65*a* and the collar portion 64*a*. The cylinder 65 has, on and around the axis of the dent 65*a*, a through-hole into which the plunger 64 is insertable. The cylinder 65 includes a discoid portion 65*b* and a side surface portion 65*c*. The discoid portion 65*b* adjoins an exterior circumferential edge of the dent 65*a* and extends outward. The side surface portion 65*c* adjoins an exterior circumferential edge of the discoid portion 65*b* and extends so as to stand in line with the frame 2.

The side surface portion 65*c* has cavities 65*d*, which are elongated and communicate with an exterior circumferential surface of the dent 65*a*. When a fire breaks out, outside airflow (natural convection) is directed through the cavities 65*d* to reach the exterior circumferential surface of the dent 65*a* adjacent to the low-melting alloy 66, to which heat is conducted accordingly. The heat-sensitive disassembling unit 6 thus promotes transfer of heat from airflow to the low-melting alloy 66 fitted in the dent 65*a*.

The heat-sensitive disassembling unit 6 includes a heat insulator 67, which is placed between an upper surface of the dent 65*a* and a lower end of the balancer 63 and is ring-shaped. When being conducted to the cylinder 65, heat of fire is blocked by the heat insulator 67 from reaching the balancer 63.

The plunger 64 has a receiving cavity 64*b*, which extends through the plunger 64 in its axial direction. The small-diameter portion 55, the inclined surface 56, and the straight portion 57, which constitute the leg of the set pin 52, are received in the receiving cavity 64*b*. Specifically, the straight portion 57 is inserted in the receiving cavity 64*b* in a manner so as to be slidable over a circumferential surface defining the receiving cavity 64*b*. The straight portion 57 is in contact with the circumferential surface defining the receiving cavity 64*b*. The breakdown action causes the set pin 52 to move, with the inclined surface 56 contacting the circumferential surface defining the receiving cavity 64*b*.

In the initial stage of the action of the heat-sensitive disassembling unit 6 of the sprinkler head S, the straight portion 57 of the set pin 52 is in contact with the interior circumferential surface of the plunger 64 of the heat-sensitive disassembling unit 6. Owing to this feature, the heat-sensitive disassembling unit 6 caught on the frame 2 moves in line with the straight portion 57 inserted in the plunger 64 when going into action to break down and to fall off from the frame 2. In this way, the sprinkler head S restricts inclination of the heat-sensitive disassembling unit 6 in the initial stage of the breakdown action of the heat-sensitive disassembling unit 6.

The guide-receiving portion 63*c* of the heat-sensitive disassembling unit 6 and the guide portion 24 of the frame 2 slide over each other until the guide-receiving portion 63*c* gets out of the guide portion 24. This may also restrict the inclination of the heat-sensitive disassembling unit 6. In this stage, the straight portion 57 of the set pin 52 and the interior circumferential surface of the plunger 64 slide over each other. Consequently, not only the heat-sensitive disassembling unit 6 but also the set pin 52 is less prone to inclination. This makes the spring member 5 less prone to inclination and lateral misalignment. In this way, the inclination of the heat-sensitive disassembling unit 6 is restricted in two spots, that is, by the straight portion 57 of the set pin 52 inserted in the plunger 64 and by the guide portion 24 of the frame 2. This enables the sprinkler head S to ensure activation reliability with greater stability.

The breakdown action of the heat-sensitive disassembling unit 6 causes the set pin 52 to move, with the inclined surface 56 contacting the interior circumferential surface of the plunger 64. The inclination of the heat-sensitive disassembling unit 6 from the interior circumferential surface of the plunger 64 may be tolerated to a certain extent owing to the inclined surface 56 of the set pin 52. Specifically, when the straight portion 57 gets out of the receiving cavity 64*b*, the receiving cavity 64*b* restricts displacement of the small-diameter portion 55 and the inclined surface 56. This eliminates or reduces the possibility that the heat-sensitive disassembling unit 6 will incline excessively. Once the inclination restriction imposed by the straight portion 57 is removed, the sprinkler head S tolerates slight to moderate inclination of the heat-sensitive disassembling unit 6 and prevents excessive inclination of the heat-sensitive disassembling unit 6.

The plunger 64 includes a thin-walled portion 64*c*, which is below the middle part of the plunger 64 in its axial direction and lies on and above the collar portion 64*a*. The wall thickness of the thin-walled portion 64*c* between its exterior circumference and its interior circumference (the receiving cavity 64*b*) is smaller than the wall thickness of the other part of the plunger 64. The cross-sectional area of the thin-walled portion 64*c* is smaller than the cross-sectional area of an upper part of the plunger 64 or the cross sectional area of the collar portion 64*a*, and heat may not be conducted efficiently through the thin-walled portion 64*c* accordingly. Owing to the thin-walled portion 64*c*, part of the plunger 64 closer to the external screw thread (the upper part of the plunger 64) is less affected by heat absorbed by the collar portion 64*a* (the lower part of the plunger 64). The thin-walled portion 64*c* extends upward from an upper end of the collar portion 64*a*, lies beyond an edge of the heat insulator 67, and extends to about the height position of the lower end of the frame 2.

Action of Sprinkler Head S (FIGS. 7A to 7E)

The following describes the action of the sprinkler head S with reference to FIGS. 7A to 7E. FIGS. 7A to 7E illustrate the activation processes of the sprinkler head S.

Figure 7A:
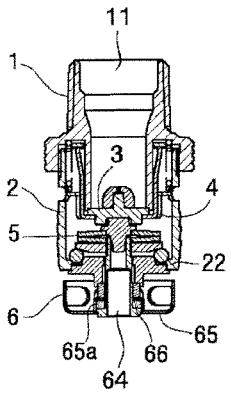
FIGS. 7A to 7E are sectional views of the sprinkler head in FIG. 1, illustrating the activation processes of the sprinkler head.
Figure 7B:
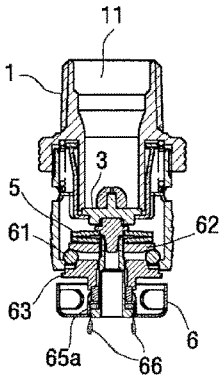
Figure 7C:
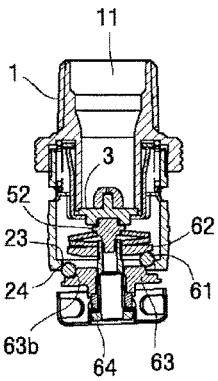
Figure 7D:
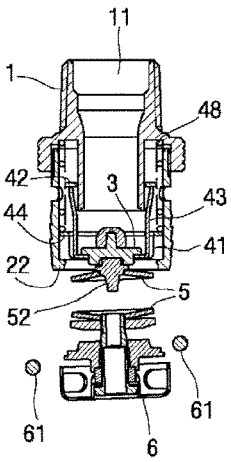
Figure 7E:
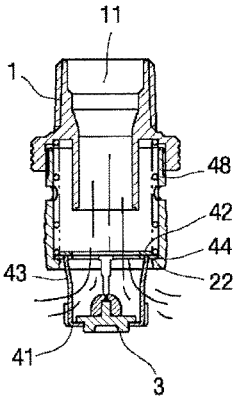
Figure 8B:
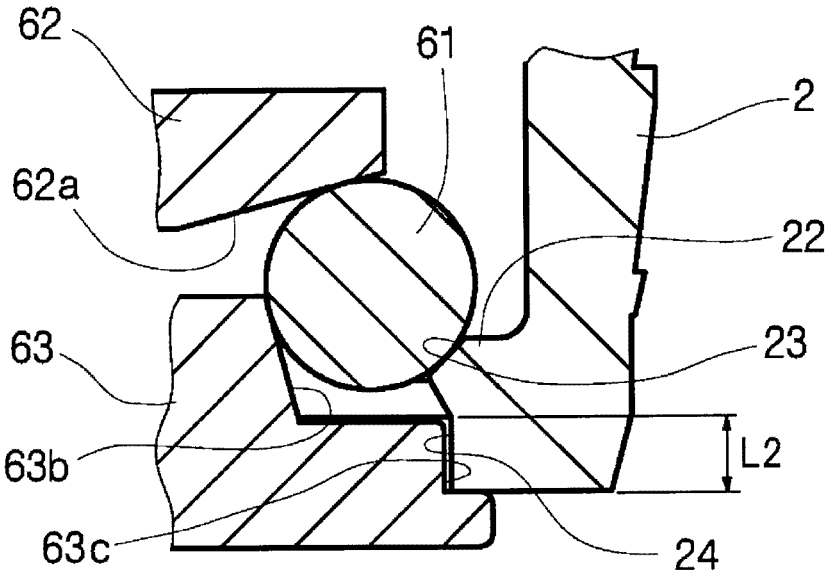

(a) While the sprinkler head S watches for an outbreak of fire (in ordinary times), the nozzle 11 of the main body 1 is supplied with pressurized fire-extinguishing water through a water-supply pipe, and pressure from the fire-extinguishing water is continuously applied to the valve element 3 (see FIG. 7A). As illustrated in FIGS. 8A and 8B, a length L1 (see FIG. 8A), which the length of the inserted section of the straight portion 57 of the set pin 52 in the receiving cavity 64*b* of the plunger 64, is shorter than a length L2 (see FIG. 8B), which is the length of the guide-receiving portion 63*c* of the balancer 63. A small clearance is left between an upper end surface of the plunger 64 and the set pin 52 in the axial direction of the sprinkler head S. The formation of the clearance is due to the bias force exerted by the coned disc springs 51*a* and 51*b*.

(b) When a fire breaks out and thermal airflow (natural convection) caused by the fire blows on the cylinder 65, heat of fire is conducted to the low-melting alloy 66. The low-melting alloy 66 then begins to melt by the application of heat from around the low-melting alloy 66, which in turn liquefies and flows out from a clearance between the plunger 64 and the dent 65*a* of the cylinder 65. Consequently, the volume of the low-melting alloy 66 between the collar portion 64*a* and the cylinder 65 is reduced (see FIG. 7B).

As the low-melting alloy 66 melts and flows out of the dent 65*a*, the cylinder 65 descends relative to the frame 2 in the axial direction of the sprinkler head S by an amount corresponding to the volume of the low-melting alloy 66 flowing out of the dent 65*a*. As the cylinder 65 descends, the heat insulator 67 and the balancer 63 overlying the cylinder 65 also descend. The elastic force of the spring member 5 is exerted on the slider 62, and the resulting bias force is exerted on the balls 61 in a manner so as to move the balls 61 toward the axis (inner side) of the sprinkler head S. The bias force acts on the balancer 63 while the balancer 63 is moving downward. That is, the force in directions different from the axial direction of the sprinkler head S acts on the balancer 63, and as a result, the heat-sensitive disassembling unit 6 is prone to inclination. However, the guide portion 24 extending along the interior circumference of the lower part of the frame 2 and the guide-receiving portion 63*c* restrict the inclination of the balancer 63 in motion. Furthermore, the straight portion 57 of the set pin 52 is guided by the interior circumferential surface of the upper part of the plunger 64. The balancer 63 with the plunger 64 inserted therein is less prone to inclination accordingly. In this way, the inclination of the heat-sensitive disassembling unit 6 is restricted in two spots, that is, by the upper part and the lower part in the axial direction of the heat-sensitive disassembling unit 6 in the frame 2 (see FIG. 7B).

When the low-melting alloy 66 flows out from the dent 65*a* and the balancer 63 descends accordingly, the guide-receiving portion 63*c* of the balancer 63 comes off from the guide portion 24 and gets out of the frame 2. When the guide-receiving portion 63*c* gets out of the guide portion 24, the heat-sensitive disassembling unit 6 is farther away from the valve element 3 than it has been before the breakdown action, as a result of the displacement of the heat-sensitive disassembling unit 6 relative to the set pin 52. The inclined surface 56, which is closer than the straight portion 57 of the leg of the set pin 52 to the heat-sensitive disassembling unit 6, is thus located at an interior circumferential end of the plunger 64.

A feature of the sprinkler head S according to the present embodiment is that the length L1 is shorter than the length L2; that is, the length of the inserted section of the straight portion 57 in the receiving cavity 64*b* of the plunger 64 is shorter than the length of the guide-receiving portion 63*c*. Owing to this feature, the inclination has already been tolerated when the guide-receiving portion 63*c* gets out of the guide portion 24 of the frame 2. In addition, the inclination of the set pin 52 is tolerated to a certain extent before the heat-sensitive disassembling unit 6 inclines. The heat-sensitive disassembling unit 6 can thus move more smoothly to fall off from the frame 2. Consequently, the clearance between the leg of the set pin 52 and the circumferential surface defining the receiving cavity 64*b* in the plunger 64 is increased, and inclination of the heat-sensitive disassembling unit 6 is thus rendered possible.

(c) When the heat-sensitive disassembling unit 6 inclines to a greater extent, the inclined surface 56 of the set pin 52 comes into contact with the receiving cavity 64*b*, and further inclination of the heat-sensitive disassembling unit 6 is not possible. In this way, excessive inclination of the heat-sensitive disassembling unit 6 is prevented. As the heat-sensitive disassembling unit 6 descends with inclination being tolerated to a certain extent, the clearance between the balancer 63 and the slider 62 gradually increases. The step portion 63*b* of the balancer 63 also descends. While bias force is acting on the balls 61 toward the axis (the inner side) of the sprinkler head S, the balls 61 are prevented from moving toward the axis by the step portion 63*b* of the balancer 63. As the descent is being made, the balls 61 in their respective positions where the clearance between the balancer 63 and the slider 62 gradually increases are more likely to move beyond the step portion 63*b* toward the axis. One of the balls 61 comes off from the upper inclined surface 23 to move beyond the descending step portion 63*b* toward the axis and is thus disengaged from the step portion 22 of the frame 2. The ball 61 then reaches the guide portion 24 located underneath the upper inclined surface 23 and is temporarily sandwiched between the step portion 63*b* of the balancer 63 and the guide portion 24 (see FIG. 7C).

This movement of one of the balls 61 causes the slider 62 to incline. As a result, the components supporting the heat-sensitive disassembling unit 6 become unbalanced. The components of the heat-sensitive disassembling unit 6 then become disengaged from each other, with freedom of movement permitted. The other balls 61 are then urged to move, and consequently, the spring member 5 and the heat-sensitive disassembling unit 6 descend immediately. In this way, the heat-sensitive disassembling unit 6 of the sprinkler head S can smoothly fall off from the frame 2.

Until the spring member 5 and the heat-sensitive disassembling unit 6 fall off from the frame 2 with the balls 61 coming off from the step portion 22, the valve element 3 is kept pressed against the nozzle end 11*a* by the action of the spring member 5, and the nozzle 11 is thus kept closed with the valve element 3. Specifically, the spring force of the spring member 5 is exerted on the set pin 52, which in turn transmits the force to the valve element 3. The nozzle end 11*a* is thus kept closed with the valve element 3 until the heat-sensitive disassembling unit 6 is completely detached. Owing to the inclined surface 56 of the set pin 52, inclination the heat-sensitive disassembling unit 6 is tolerated to a certain extent. The balls 61 can thus easily come off from the step portion 22. A lower end of the small-diameter portion 55 remains inside the plunger 64 until the heat-sensitive disassembling unit 6 falls off from the frame 2.

(d) Once the spring member 5 and the heat-sensitive disassembling unit 6 below the valve element 3 fall off from the frame 2, the load associated with the restoring force of the coil spring 48 is imposed on the guide ring 44, which in turn restricts the inclination of the deflector 41 while the valve element 3 descends to open the nozzle end 11*a*. The deflector 41 attached to the valve element 3, the support ring 42 attached to the deflector 41, and the guide ring 44 descend along with the valve element 3 (see FIG. 7D). The guide ring 44 descends with an exterior surface thereof moving along the interior circumferential surface of the frame 2.

The guide ring 44 extends in a circumferential direction along exterior surfaces of the struts 43, which move along the exterior circumferential surface of the nozzle 11. The guide ring 44 thus provides, at a predetermined spacing from the exterior circumferential surface of the nozzle 11, space in which the struts 43 move when the sprinkler head S is activated to cause displacement of the deflector 41 and the struts 43. Furthermore, each claw 47*a* between the nozzle 11 and the corresponding vane 46 eliminates or reduces the possibility that the deflector 41 will be off center with respect to the nozzle 11; that is, each claw 47*a* restricts lateral displacement of the deflector 41.

When the heat-sensitive disassembling unit 6 falls off from the main body 1 and causes displacement of the deflector 41 and the struts 43, the guide ring 44 movable along the struts 43 holding the deflector 41 restricts lateral misalignment and inclination of the deflector 41 and the struts 43. This makes it certain that when the sprinkler head S is activated, the deflector 41 moves to a predetermined position for sprinkling fire-extinguishing water, that is, to the outside of the lower part of the frame 2.

(e) The guide ring 44 descends and reaches the step portion 22 of the frame 2. The support ring 42 above the guide ring 44 keeps descending and stops on the guide ring 44. In this state, the valve element 3 and the deflector 41 are hung from the frame 2 with the struts 43. The descent made by the valve element 3 is followed by the aforementioned opening up of the nozzle end 11*a*, from which pressurized fire-extinguishing water is discharged to splatter on the deflector 41 and is sprinkled in all directions to extinguish a fire (see FIG. 7E).

The positions where the struts 43 extend toward the main body 1 from the valve-element supporting portion 41*a* are closer to the axis of the sprinkler head S so as not to coincide with the positions of the vanes 46 in the axis crossing directions. This feature of the sprinkler head S offers an advantage in that fire-extinguishing water reaching the struts 43 is guided to flow to the back side of the struts 43 (toward the outer side surface 41*b* of the deflector 41) as denoted by the dash-dot-dot lines in FIG. 4B. In this way, the amount of fire-extinguishing water that will be sprinkled on the back side of the struts 43 may be increased, and the deflector 41 can get over the relative shortage of fire-extinguishing water on the back side of the struts 43, which would otherwise hold back flows of fire-extinguishing water. This enables the sprinkler head S to sprinkle fire-extinguishing water uniformly from all around its edges. Furthermore, fire-extinguishing water discharged from the nozzle 11 and collected in the deflector 41 can easily flow to the back side of the strut 43 through the corner-trimmed edge part 46*b* (the expanded path 45A), which is a low-lying region. In this way, the deflector 41 enables a further increase in the amount of fire-extinguishing water that will be sprinkled on the back side of the struts 43.

Modifications of Embodiment

The following describes modifications of the embodiment above. In the embodiment above, the protruding member 32 (the holding member) has the disc attachment hole 32*a* (the columnar-portion push-in fitting hole), and the disc 3*a* is provided with the projection 31 (the columnar portion), which fits into the disc attachment hole 32*a*. Another conceivable design of the valve element 3 is as follows: the protruding member 32 is provided with a columnar portion, and the disc 3*a* has a columnar-portion push-in fitting hole. It is required that the plate thickness of the disc in this modification be greater than the plate thickness of the disc 3*a* in the embodiment above so that the depth of the disc attachment hole of the disc in this modification is substantially equal to the depth of the disc attachment hole 32*a*. The reason is as follows: flows of fire-extinguishing water discharged from the nozzle 11 exert pressure on the protruding member, and the disc attachment hole in this modification thus needs to be deep so that the protruding member does not easily come off from the disc.

The deflector 41 in the embodiment above includes four struts 43, which hold the deflector 41. The number of the struts 43 is not limited to this value; that is, the deflector 41 may include one or more struts. In the embodiment above, three vanes 46 are disposed between adjacent ones of the struts 43 so as to scatter, outward in the axis crossing directions of the nozzle 11, fire-extinguishing water discharged from the nozzle 11. The number of the vanes 46 between adjacent ones of the struts 43 is not limited to this value; that is, one or more vanes may be disposed between adjacent ones of the struts 43.

In the embodiment above, the protruding member 32 is a molded article of resin. This enables push-in fitting of the protruding member 32 on the disc 3*a*, and the protruding member 32 may thus be easily attached to the disc 3*a*. Alternatively, the protruding member 32 may be made of metal. It should be ensured that the protruding member 32 attached to the disc 3*a* can hold the sheet-like water-stop member. The disc 3*a* in the embodiment above is made of metal. Alternatively, the disc 3*a* made be a molded article of resin.

In the embodiment above, the projection 31 of the disc 3*a* is pushed into the disc attachment hole 32*a* of the protruding member 32, which is easily fixed to the disc 3*a* accordingly. Instead of being fixed to the protruding member 32 by push-in fitting, the disc 3*a* may be screwed into the protruding member 32. This holds true for the fixation in the aforementioned modification; that is, the protruding member 32 provided with a columnar portion may be screwed into the disc 3*a* having a columnar-portion push-in fitting hole. The protruding member 32 and the disc 3*a* may thus be firmly fixed to each other.

The protruding member 32 in the embodiment above has, on its axis, the vent 32*b*, through which pressure increased by push-in fitting of the projection 31 in the disc attachment hole 32*a* is released. Alternatively, a vent groove may be provided in an exterior circumferential surface of the projection 31 so as to extend in the longitudinal direction of the projection 31, and another vent groove may be provided in the bottom surface of the protruding member 32 so as to extend in its axis crossing direction. This enables the air trapped in the disc attachment hole 32*a* to escape along the exterior circumferential surface of the projection 31 and along the bottom surface of the protruding member 32.

What is claimed is:

1. A sprinkler head, comprising:

a main body including a nozzle from which fire-extinguishing liquid is discharged;

a valve element with which the nozzle is closed;

a heat-sensitive disassembling unit including a plunger having an interior circumferential surface, the heat-sensitive disassembling unit being configured to keep the nozzle closed with the valve element and to open the nozzle through a breakdown action during activation of the sprinkler head;

a frame having a cylindrical shape and including an upper part connected to the main body and a lower part engaged with the heat-sensitive disassembling unit;

a set pin disposed between the valve element and the heat-sensitive disassembling unit and including a leg inserted in the plunger, the leg including an inclined surface and a straight portion closer than the inclined surface to the valve element, the straight portion being in contact with and slidable over the interior circumferential surface of the plunger; and a resilient body engaged with the set pin, wherein the breakdown action causes the set pin to move, with the inclined surface contacting the interior circumferential surface of the plunger and with inclination of the heat-sensitive disassembling unit from the set pin being rendered possible, the plunger has a receiving cavity, which extends through the plunger in its axial direction, and the leg of the set pin is inserted into the receiving cavity and surrounded by the interior circumferential surface of the plunger, and, the heat-sensitive disassembling unit further includes a slider disposed under and against the resilient body, and the slider is attached to the plunger.

2. The sprinkler head according to claim 1, wherein the heat-sensitive disassembling unit includes a guide-receiving portion that is slidable over a lower-part interior circumferential surface of the frame.

3. The sprinkler head according to claim 2, wherein when the guide-receiving portion of the heat-sensitive disassembling unit gets out of the lower-part interior circumferential surface of the frame through the breakdown action, inclination of the heat-sensitive disassembling unit from the set pin is rendered possible.

4. The sprinkler head according to claim 2, wherein an inserted section of the straight portion in the plunger is shorter than the guide-receiving portion.

5. The sprinkler head according to claim 2, wherein before the guide-receiving portion gets out of the lower-part interior circumferential surface of the frame, the straight portion is separated from the interior circumferential surface of the plunger, with inclination of the set pin from heat-sensitive disassembling unit being rendered possible.

6. A sprinkler head, comprising:

a main body including a nozzle from which fire-extinguishing liquid is discharged;

a valve element with which the nozzle is closed;

a heat-sensitive disassembling unit including a plunger having an interior circumferential surface, the heat-sensitive disassembling unit being configured to keep the nozzle closed with the valve element and to open the nozzle through a breakdown action during activation of the sprinkler head;

a frame having a cylindrical shape and including an upper part connected to the main body and a lower part engaged with the heat-sensitive disassembling unit;

a set pin disposed between the valve element and the heat-sensitive disassembling unit and including a leg inserted in the plunger, the leg including an inclined surface and a straight portion closer than the inclined surface to the valve element, the straight portion being in contact with and slidable over the interior circumferential surface of the plunger; and a resilient body engaged with the set pin, wherein the breakdown action causes the set pin to move, with the inclined surface contacting the interior circumferential surface of the plunger and with inclination of the heat-sensitive disassembling unit from the set pin being rendered possible, the resilient body comprises a plurality of coned disc springs, the set pin is inserted in a first coned disc spring that is one of the plurality of coned disc springs and closer than the other one(s) of the plurality of coned disc springs to the valve element, and the plunger is inserted in a second coned disc spring that is one of the plurality of coned disc springs and closer than the other one(s) of the plurality of coned disc springs to the heat-sensitive disassembling unit.

* * * * *